US005441354A

United States Patent [19]

Broder et al.

[11] Patent Number: 5,441,354

[45] Date of Patent: Aug. 15, 1995

[54] CARRIAGE SUPPORT SYSTEM FOR COMPUTER DRIVEN PRINTER

[75] Inventors: Damon Broder; Abdolrëza Movaghar, both of San Diego; W. Wistar Rhoads, Escondido, all of Calif.

[73] Assignee: Hewlett-Packard Company, Palo Alto, Calif.

[21] Appl. No.: 321,354

[22] Filed: Oct. 11, 1994

Related U.S. Application Data

[62] Division of Ser. No. 56,639, Apr. 30, 1993, Pat. No. 5,368,403.

[51] Int. Cl.[6] ..... B41J 13/02

[52] U.S. Cl. ..... 400/636.3; 400/638; 226/181; 226/187; 226/190

[58] Field of Search ..... 400/352, 634, 636, 636.3, 400/637.2, 637.3, 637.4, 638, 641; 226/181, 186, 187, 188, 190; 101/232

[56] References Cited

U.S. PATENT DOCUMENTS

| | | | |
|---|---|---|---|
| 735,745 | 8/1903 | Fredenburgh | 226/187 |
| 1,311,688 | 7/1919 | Hagerstrom | 400/636.3 |
| 1,453,579 | 5/1923 | Armstrong | 400/636.3 |
| 1,453,580 | 5/1923 | Armstrong | 400/641 |
| 1,453,581 | 5/1923 | Armstrong | 400/636.3 |
| 1,467,996 | 9/1923 | Bridewater | 400/636.3 |
| 1,606,999 | 11/1926 | Houanson | 400/636.3 |
| 1,773,933 | 8/1930 | Barr | 400/641 |
| 3,010,565 | 11/1961 | Pasinsui | 226/186 |
| 3,252,557 | 5/1966 | Templeton | 400/636 |
| 3,391,775 | 7/1968 | Frobel | 400/636 |
| 3,421,612 | 1/1969 | Pitt | 400/636 |
| 3,850,355 | 11/1974 | Downie | 226/187 |
| 4,522,520 | 6/1985 | Takenoya et al. | 400/636.3 |
| 4,567,491 | 1/1986 | Lawrence | 400/636 |
| 4,611,939 | 9/1986 | Fujiwara | 400/636.3 |
| 4,629,177 | 12/1986 | Roddemann et al. | 226/187 |
| 5,000,439 | 3/1991 | Yoshizawa | 226/187 |
| 5,129,749 | 7/1992 | Sato | 400/636 |
| 5,163,675 | 11/1992 | Sunohara | 400/636 |
| 5,188,471 | 2/1993 | Mattila | 400/636 |
| 5,289,206 | 2/1994 | Ishikawa et al. | 400/636 |

FOREIGN PATENT DOCUMENTS

| | | | |
|---|---|---|---|
| 95970 | 8/1963 | Denmark | 226/181 |
| 2754108 | 1/1979 | Germany | 226/181 |
| 0072570 | 4/1988 | Japan | 400/641 |
| 0178149 | 9/1989 | Japan | 226/181 |
| 0226363 | 9/1989 | Japan | 400/636 |

OTHER PUBLICATIONS

"Spray-Coated Paper Feed Rolls" IBM Technical Disclosure Bulletin, vol. 25 No. 7B, Dec. 1982 p. 3976.

"Self-Adjusting Document-Feed-Seperating Device" IBM Technical Disclosure Bulletin, vol. 35 No. 1B, Jun. 1992 pp. 89-96.

"Nip Roller/Force Equalizing Assembly" IBM Technical Disclosure Bulletin, vol. 23, No. 3, Aug. 1980 p. 939.

*Primary Examiner*—Eugene H. Eickholt

[57] ABSTRACT

A carriage support system for a computer driven printer/plotter employs a slider rod and a slider bar mounted parallel to each other on a printer chassis wherein the bar supports the front side of a printer carriage and the rod supports the rear side of the carriage thus eliminating expensive centerless ground carriage support rods. The slider bar also has a plurality of dual edge paper pinch wheels supported thereon which are biased into engagement with the paper or other medium on which printing takes place by a plurality of springs integrally formed from a single member affixed to the slider bar.

12 Claims, 4 Drawing Sheets

FIG. 3
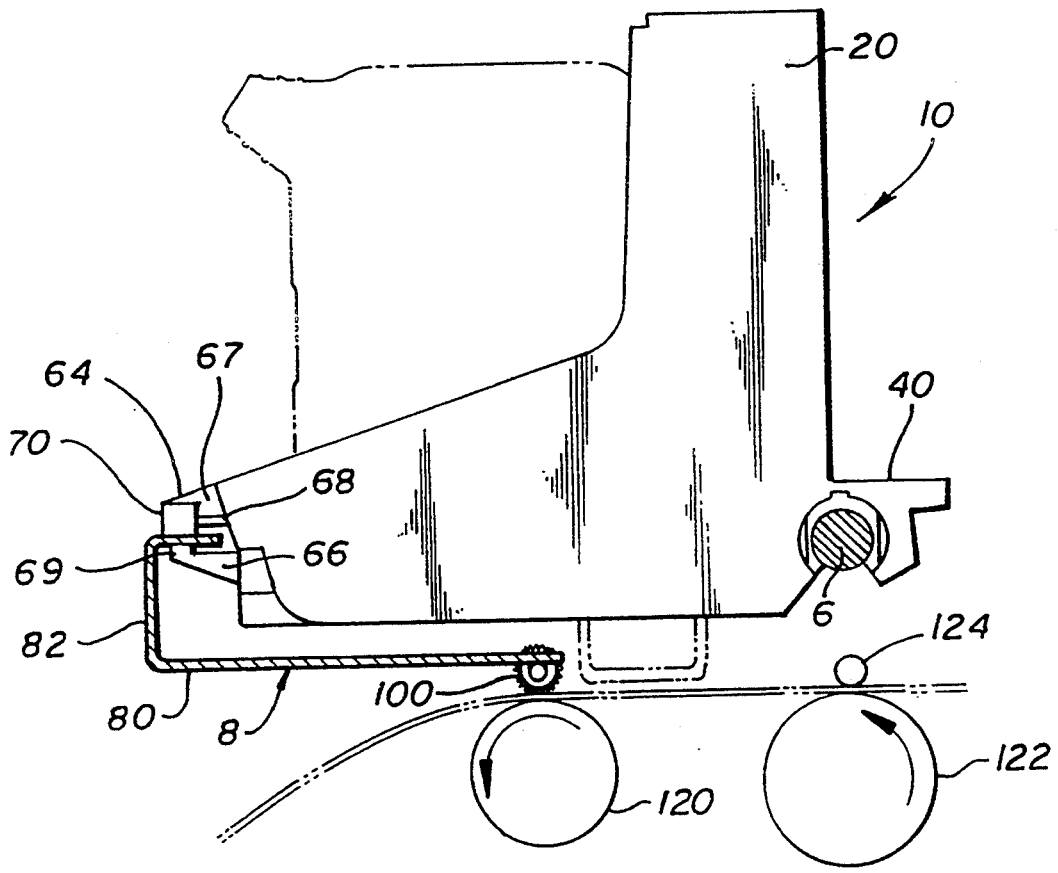
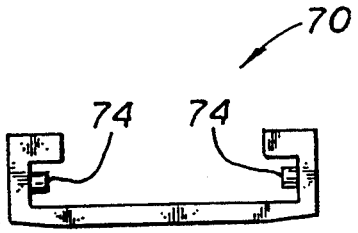
FIG. 4
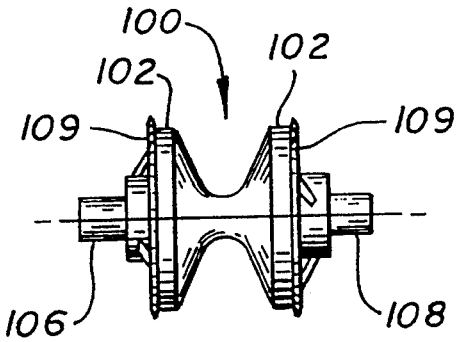
FIG. 6

CARRIAGE SUPPORT SYSTEM FOR COMPUTER DRIVEN PRINTER

CROSS REFERENCE TO RELATED APPLICATION

This is a divisional of application Ser. No. 08/056,639 filed on Apr. 30, 1993, now U.S. Pat. No. 5,368,403.

Bearings and systems for the mounting and support of printer carriages on slider rods in a printer are disclosed in application Ser. No. 07/965,480 filed Oct. 23, 1992 titled PRINTER CARRIAGE BUSHING now U.S. Pat. No. 5,346,320 by Nguyen and in Ser. No. 08/056,335, now U.S. Pat. No. 5,348,404 titled SPLIT BUSHING MOUNTING OF PRINTER CARRIAGE WITH PRE-LOAD by Movaghar, et al, both of which are assigned to the assignee of the present invention, and the disclosures of which are incorporated herein by reference.

BACKGROUND OF THE INVENTION

The present invention relates to a carriage support system for a computer driven printer/plotter carriage which slides back and forth transversely of the path of paper travel through the printer/plotter on at least one smooth support rod which is ordinarily cylindrical.

Printer/plotter carriages are typically supported on two sliding tracks such as two smooth centerless ground steel rods which are expensive to manufacture to the close tolerances required for high resolution high speed printing. A carriage support system which can be manufactured to and retain close tolerances without the attendant expense of a plurality of centerless ground steel support rods is therefore required for printer/plotter carriages which must move without impediment at a high rate of speed with frequent reversals in the direction of movement along the slider rods. In U.S. Pat. No. 4,755,836 issued to Taj, et al on Jul. 5, 1988 and assigned to the assignee of the present invention, a single slider rod relatively closely positioned on one side of the printer carriage is used in combination with a guide track positioned relatively far from the printer carriage on the other side thereof. U.S. Pat. No. 4,872,026 issued on Oct. 3, 1989 and 4,843,338 issued Jun. 27, 1989, to Rassmussen, et al and assigned to the assignee of the present invention each use a slider rod and guide track positioned on the same side of the carriage.

Carriage support systems have ordinarily been manufactured separate and apart from the paper or other print media feed system which uses a plurality of separate paper pinch wheels such as star wheels or grit wheels which are individually biased toward a paper feed roller or belt. A carriage support system which also supports the pinch wheels enables the elimination of excessive parts subject to malfunction or breakage.

An ancillary objective is therefore to provide a carriage support system in which paper engaging feed wheels or rollers of the paper or other print media moving system can also be supported from one of the same transversely mounted printer carriage supports so as to eliminate excessive parts and the cost thereof.

SUMMARY OF THE INVENTION

The present invention firstly provides a carriage support system for a computer driven printer having a moveable print head carriage, said support system comprising: a chassis having a printhead receptacle; a horizontally extending slider rod; and a horizontally extending slider bar parallel to and spaced from said slider rod, said slider rod and said slider bar each being affixed to said chassis, said slider bar having a carriage support surface, said slider rod being engageable with a distal side of said carriage and said slider bar being engageable with a proximal side of the carriage, with the printhead receptacle being positioned between said slider rod and said slider bar.

The present invention further provides a computer driven printer comprising a chassis having a front side and a rear side; print media moving means on said chassis for moving print media through the printer in a direction which extends from said front side to said rear side; a carriage having a receptacle for carrying at least one print head thereon; means for moving said carriage transversely to said direction; a carriage slider rod; and a carriage slider bar extending parallel to and spaced from said slider rod, said slider rod and said slider bar each being mounted on said chassis, said slider bar having a carriage support surface, said slider rod slideably supporting said rear side of said carriage and said slider bar slideably supporting said front side of said carriage on said support surface with said receptacle between said slider rod and said slider bar.

In a third aspect, the present invention further provides a print media moving system for a computer driven printer comprising: a chassis; a powered media drive member and an elongated media pinch wheel support member mounted on said chassis and extending transversely of the path of movement of the media, said support member having a plurality of media pinch wheel supports aligned along an axis extending transversely of the path of movement of the media, each support having a pair of spaced cradles for supporting a media pinch wheel at opposite ends of its axis of rotation; a plurality of media pinch wheels each having a media contact edge and an axis of rotation centrally extending through spaced axle ends respectively supported in said cradles; and a resilient member affixed to said support member, said resilient member having a plurality of resilient tongues which respectively bias one each of said pinch wheels toward said media drive member.

Finally, the present invention also provides a computer driven printer having a front side and a rear side; a print media moving system for moving print media through the printer in a direction which extends from said front side to said rear side; a carriage for carrying at least one print head thereon; and means for moving said carriage transversely to said direction; said print media moving system comprising: a chassis; a powered media drive member and an elongated media pinch wheel support member mounted on said chassis and extending transversely of the path of movement of the media, said support member having a plurality of media pinch wheel supports aligned along an axis extending transversely of the path of movement of the media, each support having a pair of spaced cradles for supporting a media pinch wheel at opposite ends of its axis of rotation; a plurality of media pinch wheels each having a media contact edge and an axis of rotation centrally extending through spaced axle ends respectively supported in said cradles; and a resilient member affixed to said support member, said resilient member having a plurality of resilient tongues which respectively bias one each of said pinch wheels toward said media drive member.

BRIEF DESCRIPTION OF THE DRAWING

FIG. 3 is a right side elevation view of the carriage of FIG. 2 showing the slider rod and slider bar supports in cross-section.

FIG. 4 is an enlarged view of a slider shoe used on the carriage.

FIG. 6 is an enlarged top view of a pinch wheel.

DESCRIPTION OF THE PREFERRED EMBODIMENT

Figure 1:
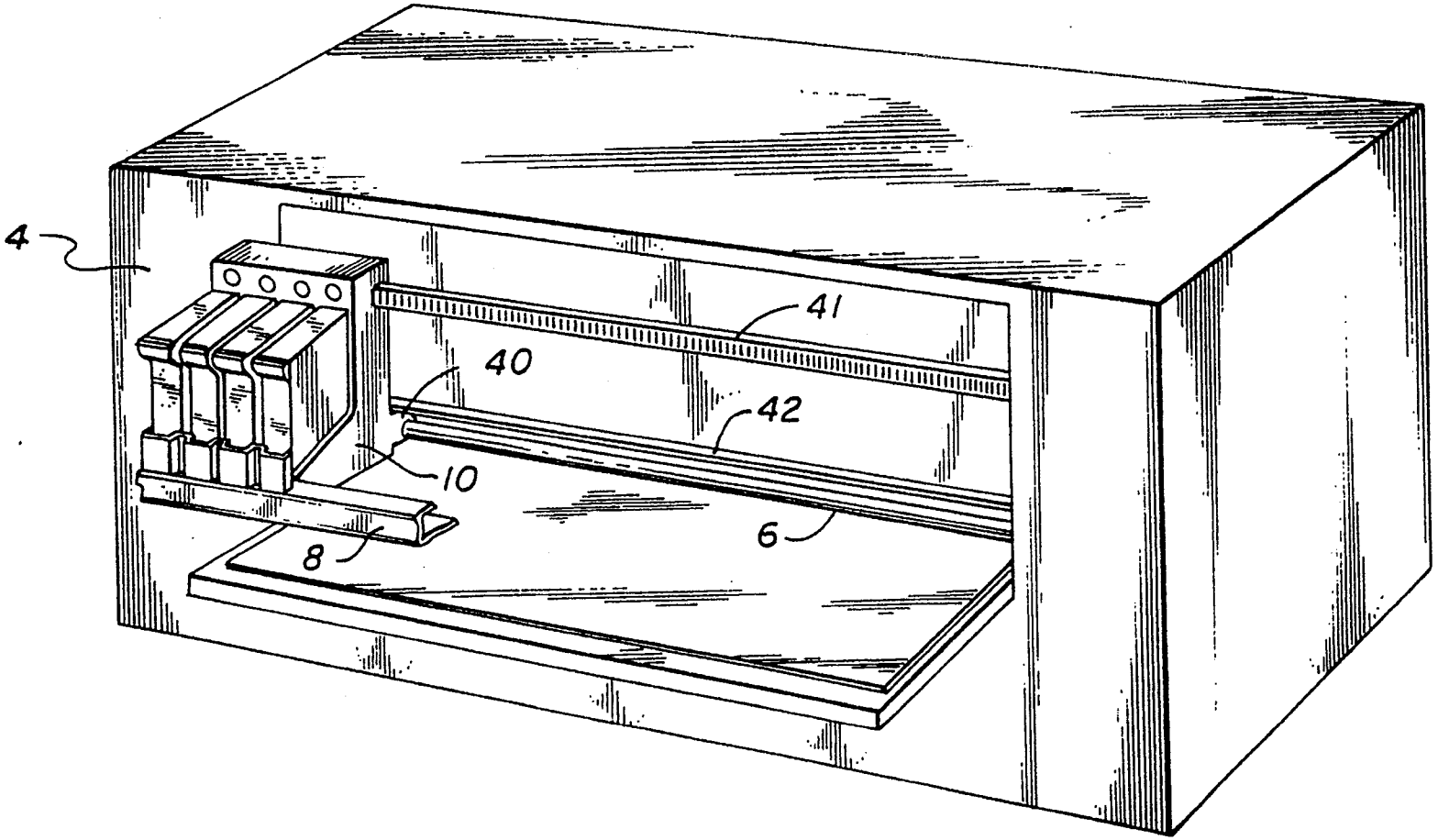
FIG. 1 is a perspective view of a computer driven printer showing the general layout of the chassis and carriage support parts thereof.
Figure 2:
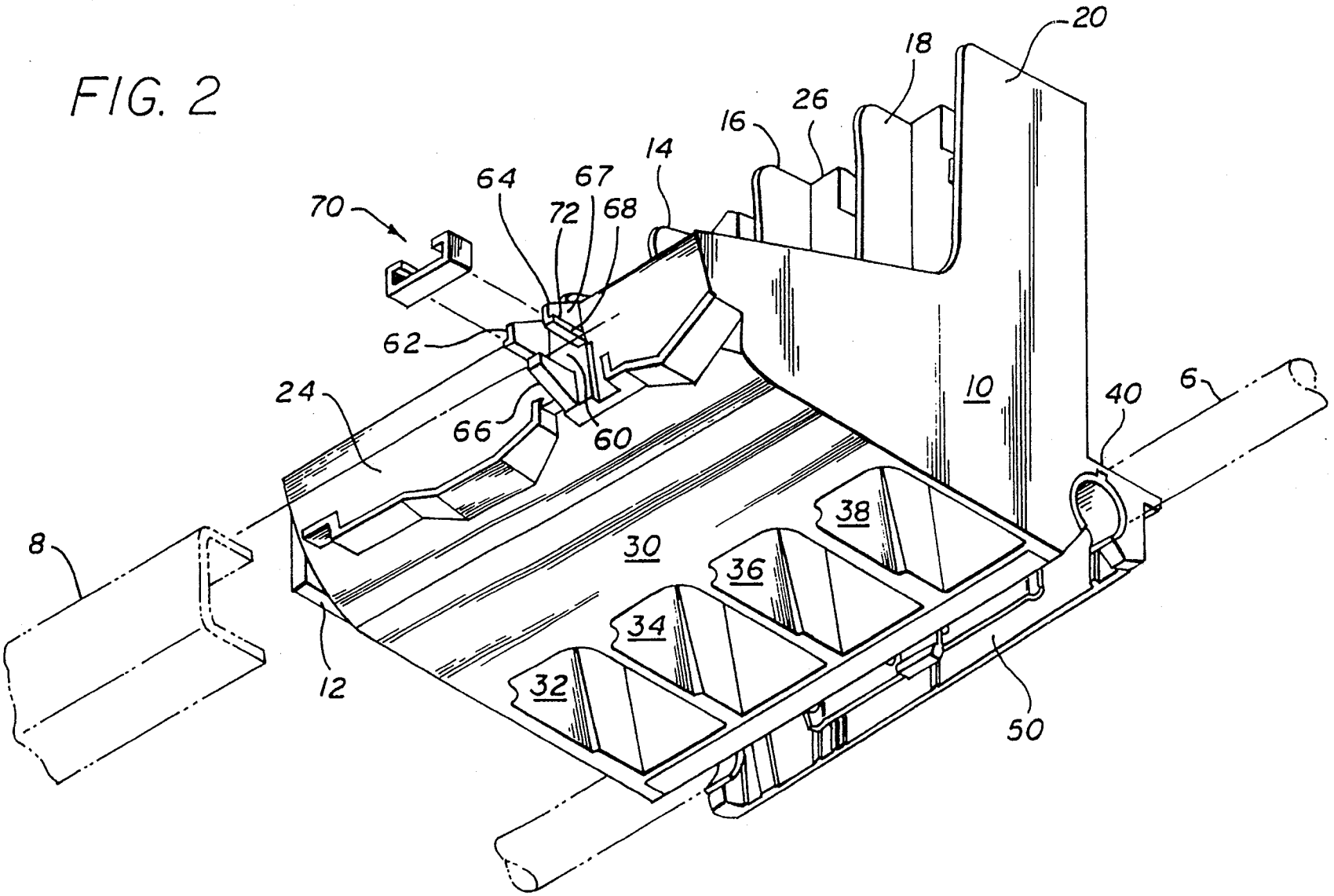
FIG. 2 is a perspective view showing the underside and the right hand side of a printer/plotter carriage mountable for sliding movement on a slider rod and a slider bar shown in phantom.

As seen in FIGS. 1 and 2, the printer 2 includes a print head carriage 10 mounted in a printer housing or chassis 4 for sliding movement on a slider rod 6 and a slider bar 8 which each extend transversely of the path of movement of the paper or other printing medium through the printer. In the embodiment shown, the carriage 10 is supported on the slider rod 6 by two laterally spaced bushings in the lower rear portion of the carriage and by a single front slider support.

FIG. 2 shows a perspective view from the bottom front of the printer carriage 10 which is particularly useful in an ink jet printer which uses a plurality of ink cartridges. Ordinarily, four ink cartridges are provided comprising the color black and three primary colors for color ink jet printing. The carriage comprises a molded plastic member comprised of five generally L-shaped parallel spaced plates 12, 14, 16, 18, 20 which define four printer cartridge receptacles therebetween. The carriage also has an integrally formed front wall 24 as well as a back wall 26 for mounting printed circuits which energize the print heads of the respective print cartridges, not shown. The carriage also has an integrally formed bottom wall 30 provided with four apertures 32, 34, 36, 38 which receive the nozzle portions of the print cartridges through which ink is jetted downwardly onto the paper or other medium on which printing is to take place.

The printer carriage 10 also has an integrally formed carriage drive belt support shelf 40 at the lower rear corner thereof and an elongated slider rod receptacle 50 disposed beneath the belt support shelf 40. The carriage 10 is supported in the printer and is pulled back and forth by a belt 42 which is connected to the carriage 10 and is supported on the shelf 40 above the slider rod. The carriage position is sensed by an optical encoder strip 41. Typical prior art carriages are supported on at least two ordinarily cylindrical slider rods whereas the carriage of the present invention is supported at the rear on a single slider rod (shown in phantom in FIG. 2) which extends through the slider rod receptacle 50 and, at the front, on the slider bar 8 (shown in phantom in FIG. 2) which has a horizontally extending flat carriage support surface. The slider bar 8 is received in a slider bar groove 60 defined between a pair of spaced upper slider bar carriage support bosses 62, 64 and at least one lower slider bar guide boss 66 on the front wall 24 of the carriage 10.

Each of the two upper slider bar bosses 62, 64 has a vertically extending web 67 and an outwardly extending horizontal flange 68 for the purpose of receiving a replaceable wear shoe 70. Each of the flanges 68 has a slight indent 72 for reception of a projecting dimple 74 on two opposed flanges of the wear shoe (FIG. 4) which comprises a channel shaped plastic section whereby the wear shoe 70 can be slipped onto the horizontal flanges 68 of the upper bosses 62, 64 where the dimples 74 will retain the shoe on the flanges by engaging the indents 72 therein. The wear shoe 70 is thus pivotally moveable on the dimples to adjust to slight variations in the profile of the slider bar and the shoe can be easily removed when desired for replacement.

The lower boss 66 on the front wall of the carriage preferably has an upper contact lip 69 which does not extend the full length of the boss. The lip 69 and the lower surface of the wear shoe 70 are spaced a distance to closely slideably receive an upper flange of the slider bar 8 as best seen in FIG. 3.

Figure 5:
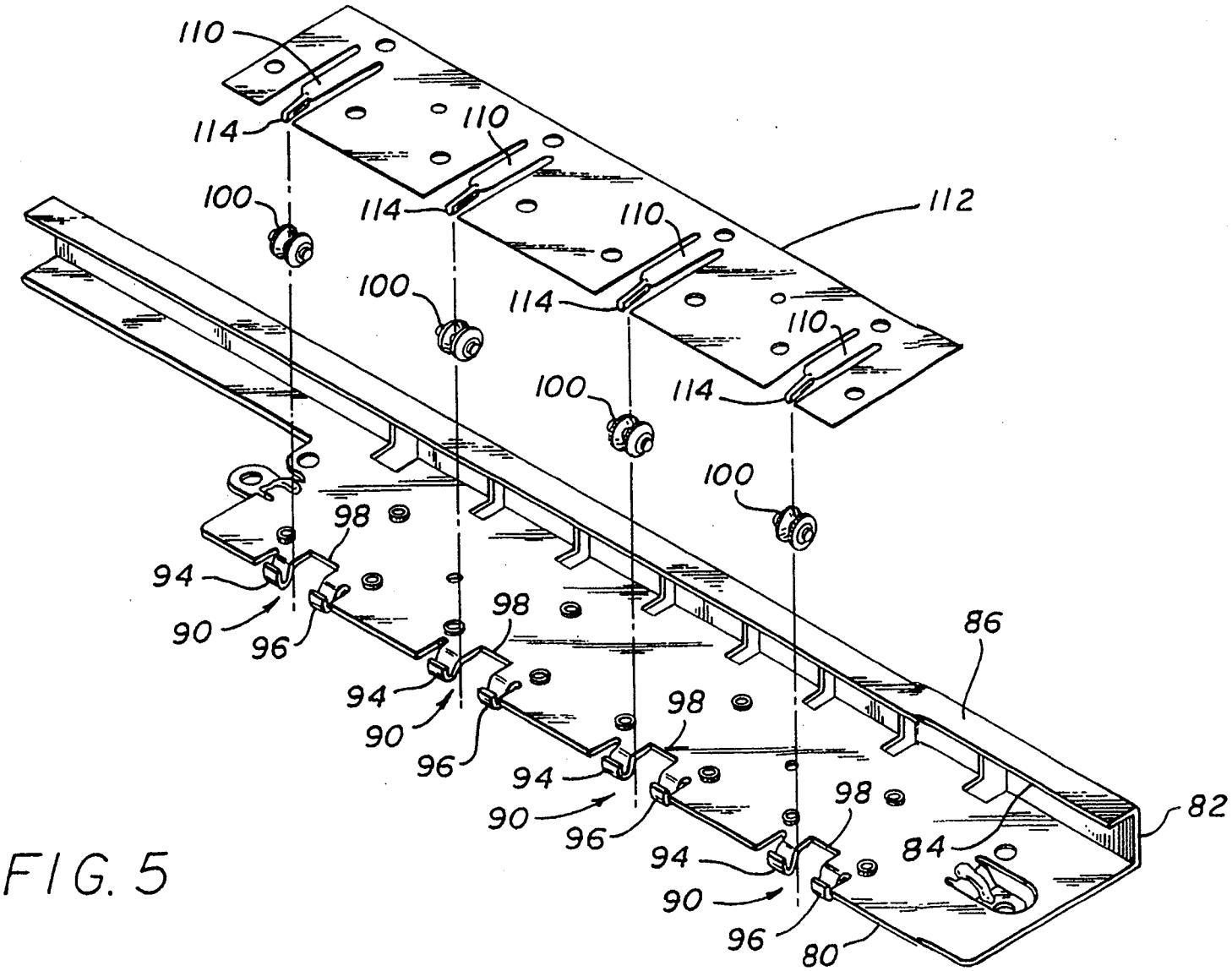
FIG. 5 is an exploded view of the slider bar, pinch wheels and spring assembly.

An exploded view of the slider bar assembly is shown in FIG. 5. The slider bar 8 preferably is fabricated from a single piece of sheet metal formed as a channel member having a relatively wide lower flange 80, a vertically extending connecting web 82 and a relatively narrow horizontally extending upper flange 84, the upper surface of which comprises a carriage support surface 86 which engages the lower surface of the slider shoe 70 to support the front portion of the carriage 10. Preferably, the carriage support surface 86 has a high molecular weight polyethylene coating thereon. This coating may be conveniently applied as a strip of tape although other means lubricating the support surface 86 of the slider bar can of course readily be devised by persons skilled in the art. It has been found that polyethylene tape is preferred for it's combined wear and lubricating properties.

Preferably, the slider bar 8 has a plurality of spring biased idler pinch wheels in the form of print media star wheels 100 supported thereon. For this purpose, a plurality of wheel supports 90 (four are shown) each comprising a pair of spaced cradles 94, 96 bent from the sheet metal on opposite sides of cutouts 98 in the wide flange of the bar 8 are sized to hold opposite ends of the axle of a star wheel 100 shown to an enlarged scale in FIG. 6. The depth and diameter of the cradles 94, 96 is sized slightly larger than the diameter of the axle ends of the pinch wheel 100 so that the wheel is supported for limited vertical movement in the cradles 94, 96. The wheels 100 are retained in the .cradles by plurality of tongues 110 formed in a resilient member 112 comprising a thin sheet of spring metal which is affixed by riveting it to the upper surface of the wide flange 80 of the slider bar 8. Each of the four tongues 110 has a wheel centering tip 114 formed by bending the laterally parallel edges of the tongue upwardly during fabrication of the resilient member 112.

As shown in FIG. 6, each wheel 100 preferably comprises a single piece of molded plastic in a general configuration of a spool having a pair of spaced parallel paper engaging edges 102 and a central axle having spaced ends 106, 108 which are received in the cradles 94, 96. The resilient tongues 110 engage the central peripheral surface of the spool shaped wheels thus biasing the wheels downwardly into the cradles toward a power driven paper tensioning roller 120 (FIG. 3) on the output or downstream side of the print zone. Paper is moved from a paper tray through the printer by the a main paper drive roller 122 and opposed idler pinch wheels 124 located where shown upstream of the print zone and it is also pulled through the print zone by the tensioning roller 120 and is held thereagainst by the spring biased pinch wheels 100. Preferably, each wheel 100 has a pair of metal disks 109 having toothed edges press fit onto the axle ends 106, 108 whereby the toothed metal edges engage the paper. The use of dual edge wheels and the self centering mounting thereof minimizes damage to the paper or other print medium without loss of traction since each of the parallel paper gripping edges of the wheels 100 engages the paper with only one-half of the force applied by the spring tongue 110. This is to be compared with typical prior art pinch or star wheels having a single paper contacting edge. Fabrication of the individual spring tongues 110 from a single resilient member 112 of spring steel has significant economic manufacturing advantages. Although the preferred embodiment shows the pinch or star wheels 100 mounted on the slider bar 8, it will be appreciated that the carriage support slider bar and the bar which supports the star wheels 100 need not be a single element although, for economies in manufacturing, fabrication of a slider bar having pinch wheel supports 90 thereon is presently preferred.

Referring again to FIG. 3, it will also become evident that most of the weight of carriage is supported to the rear on the slider rod whereas the replaceable wear shoe 70 which engages the slider bar 8 takes less of the weight of the carriage 10. Both the slider bar and the slider rod supports are located near the lower edge of the carriage slightly above the printing plane and with the print cartridges therebetween.

Persons skilled in the art will readily appreciate that various modifications can be made from the preferred embodiment thus the scope of protection is intended to be defined only by the limitations of the appended claims.

We claim:

1. A print media moving system for a computer driven printer comprising: a chassis; a powered media drive member and an elongated media pinch wheel support member mounted on said chassis and extending transversely of the path of movement of the media, said support member having a plurality of media pinch wheel supports aligned along an axis extending transversely of the path of movement of the media, each support having a pair of spaced cradles for supporting a media pinch wheel at opposite ends of its axis of rotation; a plurality of media pinch wheels each having a media contact edge and an axis of rotation centrally extending through spaced axle ends respectively supported in said cradles; and a resilient member affixed to said support member, said resilient member having a plurality of resilient tongues which respectively bias one each of said pinch wheels toward said media drive member.

2. The print media moving system of claim 1, wherein said media drive member is a drive roller.

3. The print media moving system of claim 2, wherein said pinch wheel support member comprises a flat plate having a plurality of cutouts therein respectively receiving said pinch wheels, said resilient member being affixed to a first side of said plate and said tongues biasing said wheels toward a second side of said plate.

4. The print media moving system of claim 3, wherein said cradles are located on said second side of said plate.

5. The print media moving system of claim 4, wherein said plate is metal and said cradles are bent from said plate.

6. The print media moving system of claim 5, wherein said wheels each have a pair of axially spaced paper contact edges and a low friction self-centering surface extending therebetween, said surfaces being engageable with said tongues.

7. The print media moving system of claim 6, wherein said tongues each have a wheel centering tip at the end thereof engageable with said self-centering surfaces.

8. The print media moving system of claim 7, wherein said cradles loosely cradle said axles to assist in self-centering of said wheels.

9. The print media moving system of claim 8, wherein said tongues are flat and said tips are bent to provide a convex surface engageable with said self-centering surfaces.

10. The print media moving system of claim 9, wherein each wheel comprises a spool shaped axle member and a pair of metal discs each having a toothed media engaging edge, said discs being press fit onto said axle member.

11. The print media moving system of claim 3, wherein said plate includes a carriage slider bar integrally formed therewith, said bar having a flat carriage support surface parallel to and spaced from said pinch wheel support axis.

12. The print media moving system of claim 11, wherein said plate comprises a channel having a pair of unequal length parallel flanges interconnected by a web, the shorter of said flanges comprising said slider bar and the longer of said flanges comprising said pinch wheel support member.

* * * * *